US010920649B2

(12) United States Patent
Gidla et al.

(10) Patent No.: US 10,920,649 B2
(45) Date of Patent: Feb. 16, 2021

(54) EXHAUST MANIFOLD STIFFENING RIBS

(71) Applicant: CUMMINS INC., Columbus, IN (US)

(72) Inventors: Stephen Sunadh Gidla, Greenwood, IN (US); Ryan Nelson Knight, Hope, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 16/592,278

(22) Filed: Oct. 3, 2019

(65) Prior Publication Data

US 2020/0032696 A1 Jan. 30, 2020

Related U.S. Application Data

(62) Division of application No. 15/564,379, filed as application No. PCT/US2015/025058 on Apr. 9, 2015, now Pat. No. 10,539,062.

(51) Int. Cl.
*F01N 13/10* (2010.01)
*F01N 13/18* (2010.01)

(52) U.S. Cl.
CPC ..... *F01N 13/10* (2013.01); *F01N 13/185* (2013.01); *F01N 13/18* (2013.01); *F01N 13/1861* (2013.01); *F01N 2260/18* (2013.01); *F01N 2470/04* (2013.01); *F01N 2470/26* (2013.01); *F01N 2470/28* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,537,027 | A | 8/1985 | Harwood | |
| 5,159,811 | A | 11/1992 | Hefler et al. | |
| 5,706,655 | A | 1/1998 | Kojima et al. | |
| 5,784,882 | A | 7/1998 | Bonny | |
| 6,702,062 | B2 | 3/2004 | Kusabiraki | |
| 7,497,079 | B2 | 3/2009 | Yoshida | |
| 9,238,993 | B2 * | 1/2016 | Hill, Jr. | B21D 22/02 |
| 2005/0072143 | A1 | 4/2005 | Diez | |
| 2006/0272321 | A1 | 12/2006 | Mockenhaupt et al. | |
| 2006/0277902 | A1 * | 12/2006 | Williams | F01N 13/16 60/323 |
| 2009/0013680 | A1 * | 1/2009 | Iida | F01N 13/16 60/323 |

(Continued)

OTHER PUBLICATIONS

International Search Report from corresponding PCT Application No. PCT/US2015/025058, dated Jul. 2, 2015.

(Continued)

*Primary Examiner* — Binh Q Tran
(74) *Attorney, Agent, or Firm* — Foley & Lardner LLP

(57) ABSTRACT

An exhaust manifold apparatus for routing an exhaust gas produced by an internal combustion engine is described. The manifold includes a manifold log with a log wall that defines a log bore. The log bore is in fluid communication with an upstream opening of the manifold log and a downstream opening of the manifold log. An inlet runner includes a runner wall that defines a runner bore in fluid communication with the log bore. The inlet runner is engaged to the manifold log at a stress point, which also includes at least one stiffening rib disposed on an interior surface of the log wall and/or the inlet runner wall.

6 Claims, 5 Drawing Sheets

(56) References Cited

U.S. PATENT DOCUMENTS

| | | | | |
|---|---|---|---|---|
| 2011/0308238 | A1* | 12/2011 | Grussmann | F01N 13/102 60/323 |
| 2012/0198841 | A1* | 8/2012 | Sloss | F01N 13/10 60/605.1 |
| 2014/0245983 | A1 | 9/2014 | Free et al. | |

OTHER PUBLICATIONS

Written Opinion from corresponding PCT Application No. PCT/US2015/025058, dated Jul. 2, 2015.

* cited by examiner

EXHAUST MANIFOLD STIFFENING RIBS

CROSS-REFERENCE TO RELATED APPLICATIONS

This application is a divisional of U.S. patent application Ser. No. 15/564,379, filed Oct. 4, 2017, which is the U.S. national phase of PCT Application No. PCT/US2015/025058, filed Apr. 9, 2015, the entire disclosures of which are incorporated herein by reference.

TECHNICAL FIELD

The present invention relates generally to exhaust manifold assemblies for use in routing exhaust gases from an engine to an associated aftertreatment system.

BACKGROUND

Internal combustion engines typically use accompanying exhaust manifolds to route exhaust gases produced from the combustion process away from the engine. Exhaust gas gives off heat as it travels through the downstream exhaust manifold. As such, while an internal combustion engine is in operation, a cumulative flow of exhaust gas through the exhaust manifold can give off enough heat to raise the temperature of individual manifold components, which may cause some components to expand. Over the course of one or several periods of operation, varying amounts of exhaust gas traveling through an exhaust manifold can change the temperature of individual exhaust manifold components several times, thereby causing those components to expand and contract.

SUMMARY OF THE INVENTION

One embodiment relates to a manifold for routing an exhaust gas. The manifold includes a manifold log, an inlet runner, and at least one stiffening rib. The manifold log includes a log wall having a first log thickness and defining a log bore. The log bore is in fluid communication with a first opening at an upstream end of the manifold log and a second opening at a downstream end of the manifold log. The inlet runner is operatively connected to the manifold log at the first opening, and includes a runner wall having a first runner thickness and defining a runner bore. The inlet runner includes a third opening at a downstream end thereof in fluid communication with the first opening of the manifold log, and a fourth opening at an upstream end thereof. The inlet runner engages the manifold log at a stress point. At least one stiffening rib is disposed on an interior surface of the log wall and/or the runner wall and is exposed to a bore at the stress point.

Another embodiment of the invention relates to a manifold assembly for routing an exhaust gas. The manifold assembly includes a plurality of inlet runners, a manifold log, and a plurality of stiffening ribs. The plurality of inlet runners are in fluid receiving communication with a cylinder head at upstream ends thereof; and are operatively engaged to and in fluid providing communication with the manifold log at a corresponding plurality of stress points at downstream ends thereof. Each of the plurality of inlet runners includes a runner wall having a first runner thickness. The manifold log is in fluid receiving communication with the plurality of inlet runners at the corresponding plurality of stress points, and is also in fluid providing communication with at least one outlet. The manifold log includes a log wall with having a first log thickness. Each of the plurality of stiffening ribs are disposed on an interior surface of at least one of the log wall and runner wall at one of the plurality of stress points. A stiffening rib and the log wall in combination provide a second log thickness, and a stiffening rib and the runner wall in combination provide a second runner thickness, respectively.

Yet another embodiment of the invention relates to a method of forming an exhaust manifold. The method includes forming a manifold log that includes a log wall and a log rib. The log wall is formed to have a first log thickness and define a log bore in fluid communication with a first opening at an upstream end of the manifold log and a second opening at a downstream end of the manifold log. The log rib is disposed on an interior surface of the log wall is exposed to the log bore in the vicinity of the first opening. The log rib and the log wall in combination provide a second log thickness. The method further includes forming an inlet runner having a runner wall with a first runner thickness and defining a runner bore. The inlet runner has a third opening at a downstream end thereof and a fourth opening at an upstream end thereof. The third opening is operatively connected to and in fluid communication with the first opening of the manifold log. The method also includes coupling the manifold log to the inlet runner at a stress point. The stress point is defined by a portion of at least one of the log wall and the runner wall at a junction where the first opening of the manifold log is operatively connected to the third opening of the inlet runner. The stress point is subject to greater amounts of heat fatigue than other portions of the log wall and the runner wall.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several implementations in accordance with the disclosure and are therefore, not to be considered limiting of its scope, the disclosure will be described with additional specificity and detail through use of the accompanying drawings.

Figure 1A:
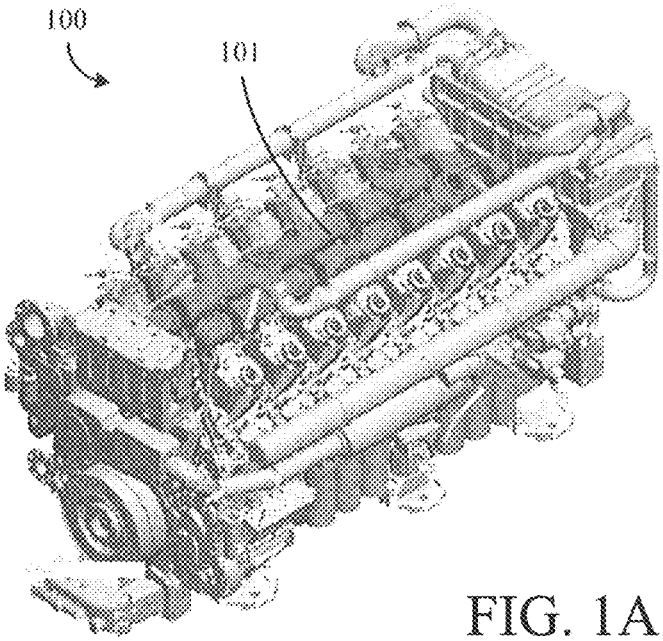
FIG. 1A is an illustrative diagram of an internal combustion engine, according to an example embodiment.

References are made to the accompanying drawings throughout the following detailed description. In the drawings, similar symbols typically identify similar components, unless context dictates otherwise. The illustrative implementations described in the detailed description, drawings, and claims are not meant to be limiting. Other implementations may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

DETAILED DESCRIPTION

Referring to FIG. 1A, an internal combustion engine 100 is configured to cyclically collect and ignite fuel from an associated fuel system and air from the intake system to generate a mechanical force. In various arrangements, the internal combustion engine 100 is configured to consume fuel in the form of gasoline (including variants thereof such as mixtures of gasoline and ethanol, E-85, and the like), diesel (including variants thereof, such as biodiesel), natural gas, or other similarly combustible fuels. As a result of each cycle of collection and ignition, an exhaust gas is created. In various arrangements, the internal combustion engine 100 includes a plurality of cylindrical bores within which the collection and ignition process takes place. In such arrangements, an associated cylinder head with intake and exhaust ports regulates the flow of intake gas into each cylinder and the flow of exhaust gas out of each cylinder, respectively. As such, a manifold assembly 101 in fluid communication with the cylinders (e.g., engaged to the cylinder head) can be configured to collect exhaust gas from the cylinder head of the internal combustion engine 100 and route the exhaust gas to an aftertreatment system. As will be appreciated from the discussion that follows, heat accumulating from a flow of exhaust gas through the manifold assembly 101 can cause individual component parts to expand and contract, which can ultimately cause some of those component parts to fail as a result of heat fatigue.

Figure 1B:
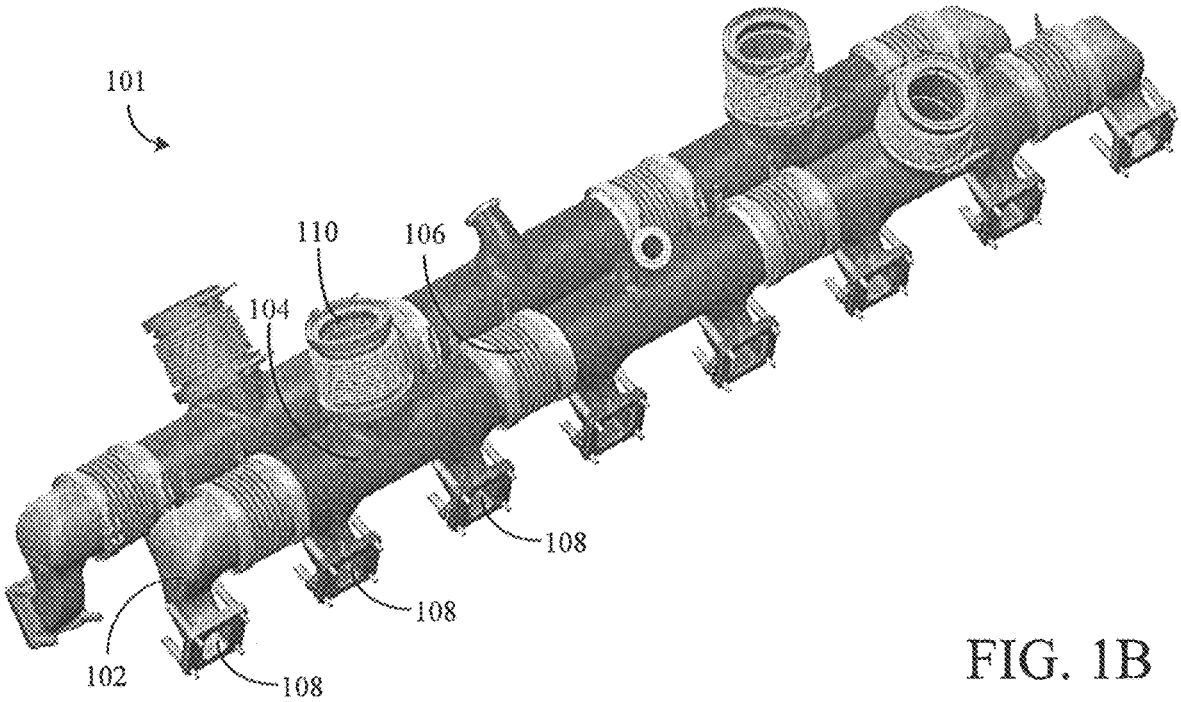
FIG. 1B is an illustrative diagram of an arrangement of exhaust manifolds associated with the internal combustion engine shown in FIG. 1A.

Referring to FIG. 1B, the manifold assembly 101 is an example arrangement of a plurality of removably engaged manifold components that can include a single head manifold portion 102, a double head manifold portion 104, a bellows 106, an inlet 108, and an outlet 110. Specifically, in the embodiment shown in FIG. 1B, the manifold assembly 101 includes two exhaust gas flow circuits that are overall in parallel, each circuit including three double head manifold portions 104 in a row with a single head manifold portion 102 at either end of each row (i.e., a total of two single head manifolds 102 for each circuit), each manifold component being interconnected via a bellows 106 (i.e., for a total of four segments of bellows 106 in each circuit).

The single head manifold portion 102 and the double head manifold portion 104 define interconnected conduits, each of which being configured to engage the cylinder head at an upstream end of the manifold assembly 101 and route an incoming flow of exhaust gas to the outlet 110 at a downstream end of the manifold assembly 101. Each manifold includes at least one inlet 108 (i.e., the single head manifold portion 102 includes one inlet 108, and the double head manifold portion 104 includes two inlets 108), each of which being in fluid receiving communication with at least one exhaust port disposed in the cylinder head. In this particular arrangement, the manifolds are interconnected by a bellows 106 at each inter-manifold junction. The bellows 106 is a flexible conduit configured to allow for a range of deformation while accommodating a gas flow through a hollow bore within. In operation, an exhaust gas flow from the cylinder head originates from at least one inlet 108, flowing downstream through at least one manifold (e.g., a single head manifold portion 102 or a double head manifold portion 104), and out through at least one outlet 110 into the remainder of an associated exhaust system.

Although FIG. 1B shows one particular example arrangement of the manifold assembly 101, various configurations of the manifold assembly 101 can be fashioned to fit a variety of applications. In some arrangements, an individual manifold component or portion can have more than one or two heads (e.g., a triple head or quadruple head manifold portion with three or four inlet runners, respectively). Further, individual manifold components or portions can be interconnected with other manifolds or conduits in the absence of a bellows 106 (e.g., a double head manifold portion 104 can be directly engaged to a single head manifold portion 102). In addition, a given manifold assembly 101 can be configured such that some manifold components or portions include one or more outlets 110, while other components do not include any outlets 110 (e.g., one double head manifold portion 104 in a circuit contains an outlet 110 while an adjacent interconnected double head manifold portion 104 does not; or a double head manifold portion 104 includes two outlets 110, while adjacent interconnected manifold portions have no outlets 110). In some arrangements, the manifold assembly 101 only has one manifold component (e.g., one double head manifold portion 104 with an outlet 110, and no interconnected manifolds or bellows).

Figure 2A:
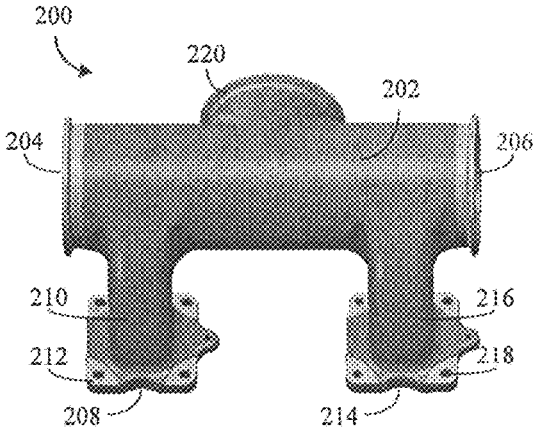
FIGS. 2A-2C depict three views of an exhaust manifold component of the arrangement shown in FIG. 1B.

Referring to FIG. 2A, a first double head manifold 200 includes a log 202, a first connector 204, a second connector 206, a first inlet 208, a second inlet 214, and a manifold outlet 220. The log 202 is a conduit with a hollow bore in fluid communication with a first opening corresponding to the first connector 204 at one end, and a second opening corresponding to the second connector 206 at the opposite end. The first connector 204 and second connector 206 each define an inter-manifold junction, wherein another manifold component or portion can engage and be in fluid communication with the first double head manifold 200. In some arrangements, the first connector 204 and second connector 206 can be configured to engage a bellows (e.g., bellows 106) disposed at an inter-manifold junction.

The first inlet 208 and the second inlet 214 are each in fluid receiving communication with at least one exhaust port of a cylinder head, and defines a third and fourth opening in the double head manifold 200, respectively. In addition, a first flange 212 and a second flange 218 are annularly disposed about the first inlet 208 and second inlet 214, respectively. The first flange 212 and the second flange 218 are configured to provide strong points of engagement between the first double head manifold 200 and a corresponding cylinder head. In some arrangements, both flanges 212, 218 include a plurality of bores configured to accommodate a corresponding plurality of bolts. As such, bolts disposed through the flange bores and into the cylinder head can be used to secure the flanges 212, 218, and therefore the first double head manifold 200, to the cylinder head.

A first inlet runner 210 and a second inlet runner 216 are configured to route an exhaust gas flow received from a cylinder head at the first inlet 208 and the second inlet 214, respectively, to the log 202. The first inlet runner 210 is a conduit in fluid communication with the log 202 at a downstream end and the first inlet 208 at an upstream end. The second inlet runner 216 is also in fluid communication with the log 202 at a downstream end, and the second inlet 214 at an upstream end. The first inlet runner 210 and the second inlet runner 216 extend laterally from the log 202 (e.g., approximately perpendicular to the log 202), and are configured to allow the first inlet 208 and the second inlet 214 to engage a cylinder head. As can be appreciated in FIG. 2A, the first inlet runner 210 and the second inlet runner 216 are disposed approximately in parallel relative to each other.

Figure 2B:
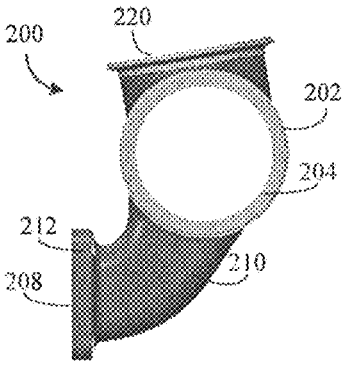
Figure 2C:
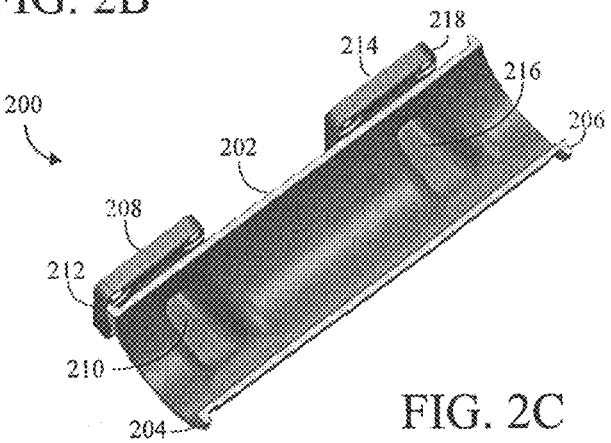

Referring to FIG. 2B, in this particular embodiment, the wall thickness of the log 202 forming the interior bore is substantially uniform. In addition, referring to FIG. 2C, the inner wall of the log 202 between the first inlet runner 210 and the second inlet runner 216 is substantially smooth and uniform as well.

Figure 3A:
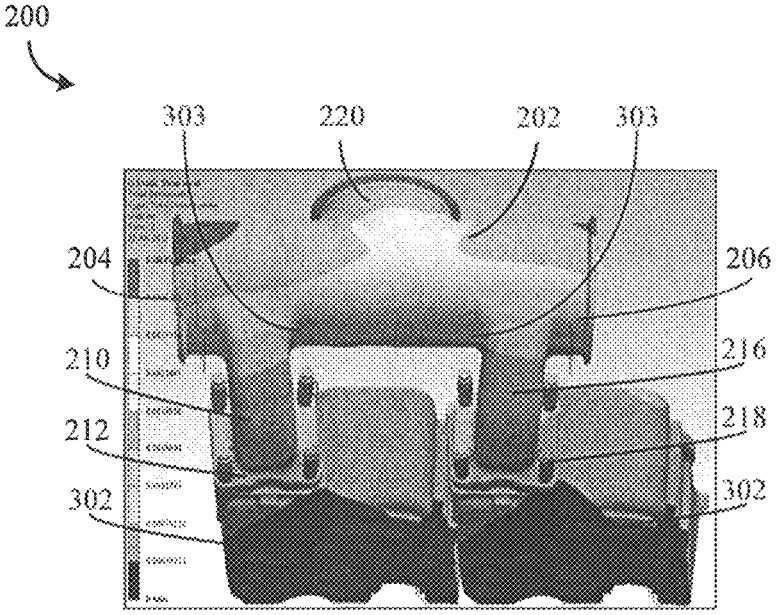
FIG. 3A is an illustrative diagram showing an example deformation of the exhaust manifold component shown in FIGS. 2A-2C.

Referring to FIG. 3A, in operation, an exhaust gas flow from a cylinder head 302 through the first double head manifold 200 begins at the first inlet 210 and the second inlet 214. The gas flow subsequently travels into the log 202 and out the manifold outlet 220. Additional gas flows from adjacent manifolds (e.g., other single or double head manifolds, which may be engaged to the first double head manifold 200 via a bellows) can also travel downstream into the first connector 204 and the second connector 206, into the log 202, and out the manifold outlet 220. Exhaust gas from a plurality of inlet runners (i.e., first inlet runner 210, second inlet runner 216, and inlet runners associated with adjacent manifold components or portions that are engaged to the first double head manifold 200) and a corresponding plurality of exhaust ports therefore collect and flow through the log 202 before flowing out of the manifold outlet 220. In operation, as one skilled in the relevant art would recognize, the configuration of the inlet runners 210, 216 as engaged to the manifold log 202 causes stress at distinct areas of the double head manifold 200 in the manner discussed below. These areas where stresses occur are referred to herein as "stress points."

In this particular embodiment, the first flange 212 and the second flange 218 securely fasten the upstream end of the first inlet runner 210 and the second inlet runner 216 to the cylinder head 302, limiting the ability of the log 202 to expand. During operation, the log 202 weakens and tends to expand to a greater degree than the cylinder head 302. Both the first inlet runner 210 and the second inlet runner 216 extend from a common side of the log 202 and are securely fastened to the cylinder head 302, preventing adjacent portions of the common side of the log 202 to slide as the log 202 seeks to expand. As a result, a compression effect occurs and the log 202 yields and compresses at a stress point 303 located at the medial side of each inlet runner-log junction. The first inlet runner 210 and the second inlet runner 216 are thus disposed at an irregular angle relative to each other due to the compression at each stress point 303, as opposed to being disposed approximately in parallel as discussed above with respect to FIG. 2A. Over the course of an internal combustion engine's lifetime, such compressions can occur many times and to various degrees based on number of uses (i.e., the number of periods of operation) or engine load (e.g., periods of heavy load and periods of light load).

Figure 3B:
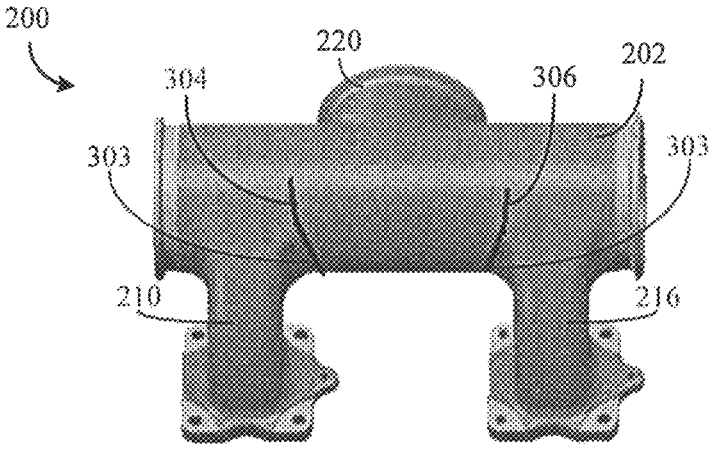
FIG. 3B is an illustrative diagram of a damaged version of the exhaust manifold component shown in FIGS. 2A-2C, according to an example embodiment.

Referring to FIG. 3B, fatigue caused by compressions and deformations as discussed with respect to FIG. 3A over the life of a given internal combustion engine can cause an exhaust manifold to fail. In one arrangement, heat fatigue gives rise to a first failure 304 and a second failure 306. The first failure 304 is a crack in the log 202 at the stress point 303 adjacent to the first inlet runner 210. Accordingly, the second failure 306 is a crack in the log 202 at the stress point 303 adjacent to the second inlet runner 216. The first failure 304 and the second failure 306 can result in a number of functional issues in the associated internal combustion engine. For example, where the internal combustion engine includes a turbocharger, the first failure 304 and the second failure 306 can result in a decreased flow of exhaust gas to the turbocharger (i.e., where some exhaust gas escapes from cracks at the first failure 304 and/or the second failure 306), thereby hindering the performance of the turbocharger. As another example, where an associated exhaust assembly disposed downstream from the first double head exhaust manifold 200 includes one or more sensors (e.g., an O2 sensor exposed to a flow of exhaust gas in the exhaust assembly), a leak at the first failure 304 and/or the second failure 306 can result in additional issues stemming from inaccurate sensor readings (e.g., the internal combustion assembly running rich or lean as a result of inaccurate O2 readings).

As yet another example, the first flange 212 and the second flange 218 can ratchet closer to each other over time as a result of cyclic thermal compression and yielding, ultimately causing associated flange fasteners (e.g., threaded bolts or screws) to fail (e.g., where the ratcheting action causes flange bolts to shear). In addition, the ratcheting action can cause the first flange 212 and/or the second flange 218 to become misaligned with the cylinder head 302, preventing the first double head manifold 200 from being remounted to the cylinder head 302 (e.g., during an engine rebuild or some other service event). Further, with respect to other aspects of an associated manifold assembly (e.g., the manifold assembly 101), as the first flange 212 and the second flange 218 ratchet closer together over time, the overall size of the log 202 can shrink, thereby impeding the ability of the first double head manifold 200 to engage other manifold components. For example, where the first double head manifold 200 is engaged to another manifold component by a bellows (e.g., bellows 106), the log 202 may shrink to such an extent that the bellows is unable to connect the first double head manifold 200 to another manifold component. As a result, the bellows and/or the first double head manifold 200 may need to be replaced during a service event before the associated manifold assembly can be reassembled.

Figure 4A:
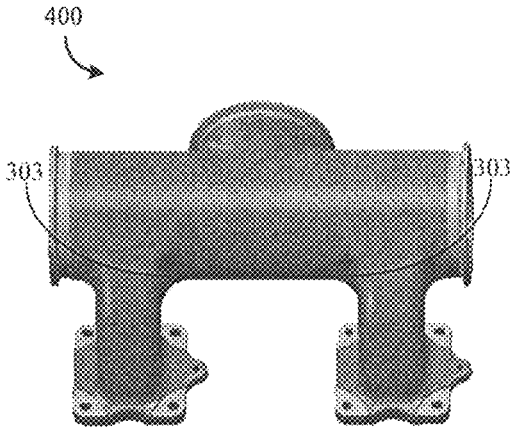
FIGS. 4A-4C depict three views of an exhaust manifold component of the arrangement shown in FIG. 1B that includes a pair of stiffening ribs, according to an example embodiment.

Referring to FIG. 4A, a second double head manifold 400 includes additional features configured to inhibit heat fatigue-based failure at the stress points 303. The second double head manifold 400 is configured to fit the same applications as the first double head manifold 200, and as can be appreciated from FIG. 4A, the second double head manifold 400 also maintains a substantially similar size, shape, and outward appearance as the first double head manifold 200.

Figure 4B:
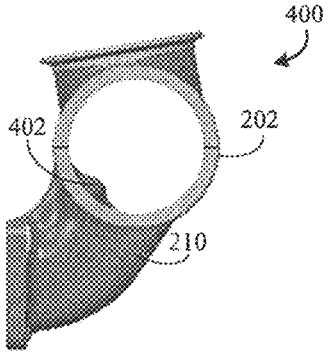

Referring to FIG. 4B, the second double head manifold 400 includes a first log rib 402. The first log rib 402 is a section of the log 202 wall with an increased log wall thickness relative to other sections of the log 202. In particular, the first log rib 402 protrudes into the log 202, effectively narrowing a portion of the bore defined by the log 202 that includes the first log rib 402. In some arrangements, the increased wall thickness associated with the first log rib 402 can extend into the first inlet runner 210, such that a portion of the first inlet runner 210 wall is thickened as well, which is discussed in more detail with respect to FIG. 4C, below.

Figure 4C:
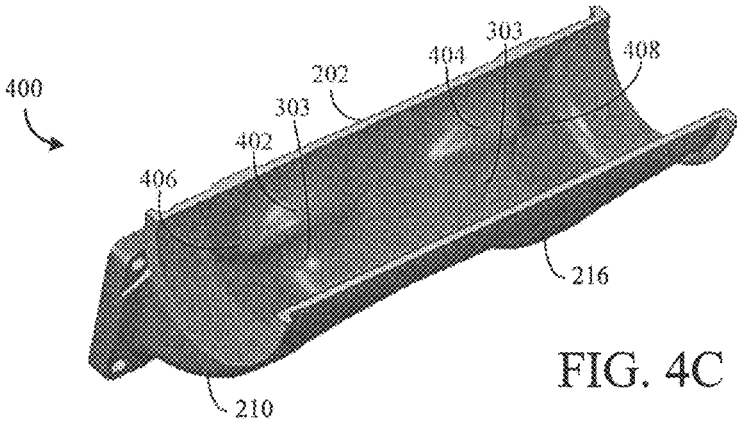

Referring to FIG. 4C, as mentioned above with respect to FIG. 4B, stiffening ribs are disposed in the second double head manifold to provide support at the stress points 303. Stiffening ribs are supporting segments of additional material (i.e., material used to form a given manifold, such as iron, steel, alloys, and the like) substantially disposed on a bore-facing segment of a given manifold. In the double head manifold arrangement shown, the first log rib 402 and a second log rib 404 are disposed in the log 202, each of which protrude into the bore of the log 202. In addition, a first runner rib 406 and a second runner rib 408 are disposed in the first inlet runner 210 and second inlet runner 216, respectively. In arrangements such as the second double head manifold 400 shown, a log rib (e.g., first log rib 402) can be formed such that it continues into an adjacent runner rib (e.g., first runner rib 406). The stiffening ribs are disposed in the second double head manifold 400 along the medial surface of the two inlet-log junctions in the vicinity of the stress points 303.

Figure 5:
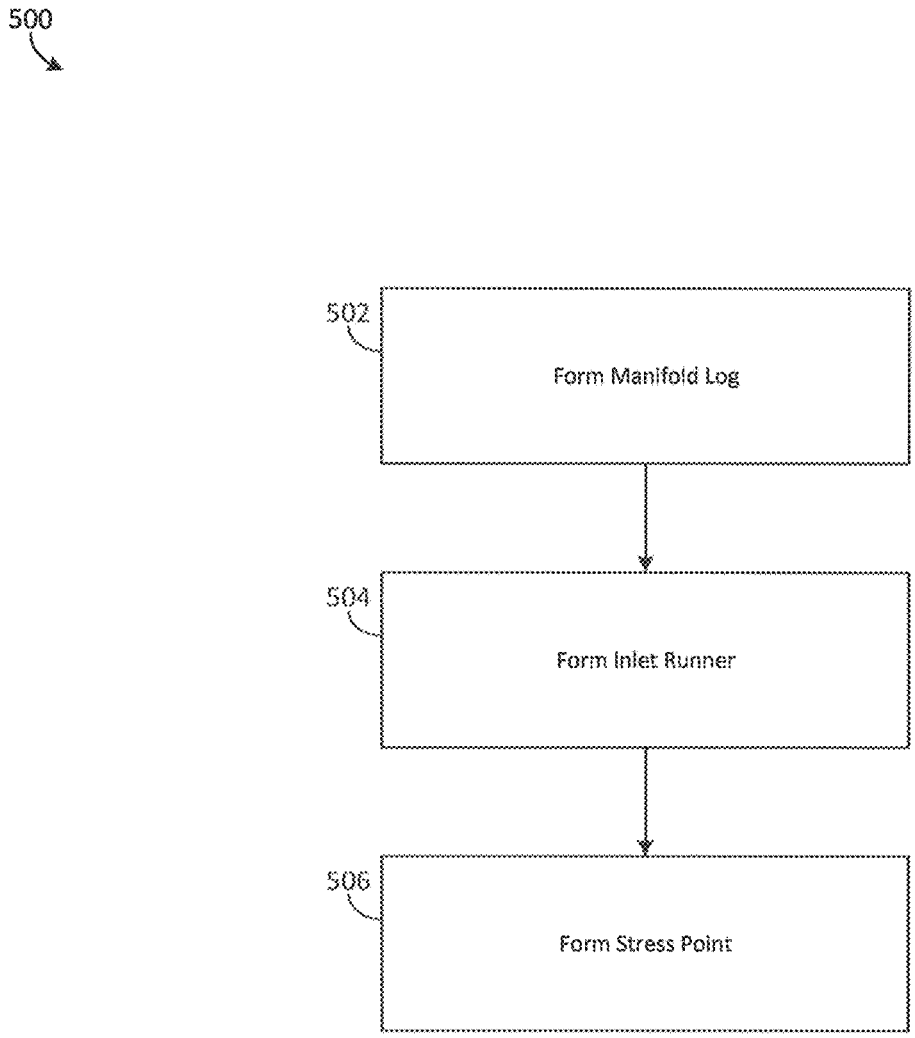
FIG. 5 is a flow diagram showing steps of a method of crafting an exhaust manifold with a stiffening rib, according to an example embodiment.

Referring to FIG. 5, a method 500 of forming an exhaust gas manifold includes forming a manifold log (e.g., log 202) at 502. The manifold log is formed through any of several manufacturing processes including, for example, casting, stamping and rolling, and so on. The manifold log can also be made up of any of several materials including iron, steel, aluminum, and so on, including alloys thereof. The manifold log is formed as a conduit with at least two openings, one opening disposed at an upstream end of the manifold log and another opening disposed at a downstream end of the manifold log, with both openings being in fluid communication with a log bore running through the length of the manifold log. The log bore is defined by a log wall with a first log thickness that gives rise to the overall shape of the manifold log and the cross sectional area of the log bore. In some arrangements, the first log thickness is generally consistent throughout the manifold log, with the exception of additional features to fit specific applications (e.g., flanges, bolt holes, clamp seats, and so on).

In some arrangements, a stiffening rib (e.g., first log rib 402) is formed along with the manifold log at 502. The stiffening rib is a log wall portion with an increased wall thickness relative to other portions of the log wall. In some arrangements, the manifold log can be formed with a stiffening rib disposed on the log wall such that the stiffening rib effectively narrows the log bore. The stiffening rib can be formed simultaneously during the forming of the manifold log at 502, or can be added after the initial forming of the manifold log at 502. For example, in one embodiment, the stiffening rib can be included in the log wall as the manifold log is casted. In another embodiment, the stiffening rib can be welded into a preexisting log wall and runner wall.

At 504, at least one inlet runner (e.g., inlet runner 210) is formed. The inlet runner can be formed via the same or similar types of manufacturing processes as the manifold log, and can be made up of the same or similar types of materials. The inlet runner can also be formed as a conduit with at least two openings, one at an upstream end and another at a downstream end, both of which being in fluid communication with a runner bore disposed through the length of the inlet runner. The runner bore is defined by a corresponding runner wall with a first runner thickness giving rise to the overall shape of the inlet runner and the cross sectional area of the runner bore. In some arrangements, the upstream end of the inlet runner is configured to removably engage a portion of a cylinder head that includes at least one exhaust port (e.g., where the upstream end of the inlet runner includes a flange). The downstream end of the inlet runner is configured to engage the upstream end of the manifold log, such that the downstream opening of the inlet runner is in fluid communication with the upstream opening of the manifold log. In some arrangements, the inlet runner is formed separately and is later coupled to the manifold log. In other arrangements, the inlet runner is formed together with the manifold log, and as such, the inlet runner and manifold log are formed as a single-piece, monolithic unit.

Also similar to the forming of the manifold log at 502, the inlet runner can be formed at 504 to include a stiffening rib (e.g., first runner rib 406) as well. The stiffening rib here can be a runner wall portion with an increased wall thickness relative to other portions of the runner wall. The stiffening rib in the inlet runner formed in the inlet runner can be made in a similar way as the stiffening rib formed in the manifold log at 502 (e.g., narrowing the runner bore, integrally formed with the inlet runner or separately and later added, and so on). In some arrangements, the stiffening rib is a single, continuous rib that begins at a runner rib and continues to and extends through a log rib. Further, the stiffening rib can also be a single, continuous rib that begins at a first runner rib, continues to and extends through a log rib, and continues to and terminates at a second runner rib.

At 506, a stress point (e.g., stress point 303) is formed. The stress point typically is formed in the vicinity of the junction where the manifold log joins the inlet runner. The stress point is an area of the log wall and/or the runner wall that is subject to heat fatigue due to an unequal deformation of the inlet runner with respect to the manifold log, as a result of a distribution of heat arising from a flow of exhaust gas within the runner bore and the log bore. Further, the stress point can be formed such that it includes a log rib and/or a runner rib. In some arrangements, the inlet runner and the manifold log together define two angles at the inlet runner-manifold log junction: a large angle and corresponding a small angle. The small angle is a resulting angle that is less than 180 degrees, and the corresponding large angle is a resulting angle that is greater than 180 degrees (i.e., the small angle and the large angle together add up to 360 degrees). For example, in an embodiment where the manifold log and the inlet runner gives rise to an overall perpendicular shape, the small angle is 90 degrees and the corresponding large angle is 270 degrees. In such an example, the stress point can include areas of the log wall and the runner wall that defines the small angle.

As utilized herein, the terms "substantially" and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described without restricting the scope of these features to the precise numerical ranges provided. Accordingly, these terms should be interpreted as indicating that insubstantial or inconsequential modifications or alterations of the subject matter described and are considered to be within the scope of the disclosure.

Further, as utilized herein, the term "fluid" is intended to have a broad meaning in harmony with the common and accepted usage by those of ordinary skill in the art to which the subject matter of this disclosure pertains. In particular, it should be understood by those of skill in the art who review this disclosure that "fluid" contemplates matter capable exhibiting a flow, and may include matter in a gaseous state, a liquid state, or some combination of components in various states of matter.

It should be noted that the orientation of various elements may differ according to other exemplary embodiments, and that such variations are intended to be encompassed by the present disclosure. It is recognized that features of the disclosed embodiments can be incorporated into other disclosed embodiments.

It is important to note that the constructions and arrangements of apparatuses or the components thereof as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

While various inventive embodiments have been described and illustrated herein, those of ordinary skill in the art will readily envision a variety of other mechanisms and/or structures for performing the function and/or obtaining the results and/or one or more of the advantages described herein, and each of such variations and/or modifications is deemed to be within the scope of the inventive embodiments described herein. More generally, those skilled in the art will readily appreciate that, unless otherwise noted, any parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is therefore to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The indefinite articles "a" and "an," as used herein in the specification and in the claims, unless clearly indicated to the contrary, should be understood to mean "at least one."

The claims should not be read as limited to the described order or elements unless stated to that effect. It should be understood that various changes in form and detail may be made by one of ordinary skill in the art without departing from the spirit and scope of the appended claims. All embodiments that come within the spirit and scope of the following claims and equivalents thereto are claimed.

What is claimed is:

1. A method of forming an exhaust manifold comprising:

forming a manifold log including a log wall and a log rib, the log wall having a first log thickness and defining a log bore in fluid communication with a first opening at an upstream end thereof and a second opening at a downstream end thereof, and the log rib being disposed on an interior surface of the log wall and exposed to the log bore in the vicinity of the first opening, wherein the log rib and the log wall in combination provide a second log thickness;

forming an inlet runner including a runner wall having a first runner thickness and defining a runner bore in fluid communication with a third opening at a downstream end of the inlet runner and a fourth opening at an upstream end of the inlet runner, wherein the third opening is operatively connected to and in fluid communication with the first opening; and coupling the manifold log to the inlet runner at a stress point, the stress point being defined by a portion of at least one of the log wall and the runner wall at a junction where the first opening of the manifold log is operatively connected to the third opening of the inlet runner, wherein the stress point is subject to greater amounts of heat fatigue than other portions of the log wall and the runner wall.

2. The method of claim 1, wherein the manifold log is integrally formed with the inlet runner as a single-piece construction.

3. The method of claim 1, wherein the manifold log is formed as a separate component that is coupled to the inlet runner.

4. The method of claim 1, wherein the log rib is integrally formed with the manifold log as a single-piece construction.

5. The method of claim 1, wherein the log rib is formed as a separate component that is coupled to the manifold log.

6. The method of claim 1, wherein the inlet runner is formed to further include a runner rib disposed on an interior surface of the runner wall and exposed to the runner bore in the vicinity of the third opening, wherein the runner rib and the runner wall in combination provide a second runner thickness.

* * * * *